US010055981B2

(12) United States Patent
Downs et al.

(10) Patent No.: US 10,055,981 B2
(45) Date of Patent: Aug. 21, 2018

(54) TRAFFIC SPEED MODELING

(71) Applicant: HERE Global B.V., Veldhoven (NL)

(72) Inventors: Oliver B. Downs, Redmond, WA (US); Toby Tennent, Chicago, IL (US); Bruce Bernhardt, Wauconda, IL (US)

(73) Assignee: HERE Global B.V., Eindhoven (NL)

( * ) Notice: Subject to any disclaimer, the term of this patent is extended or adjusted under 35 U.S.C. 154(b) by 7 days.

(21) Appl. No.: 14/736,760

(22) Filed: Jun. 11, 2015

(65) Prior Publication Data

US 2016/0364983 A1 Dec. 15, 2016

(51) Int. Cl.

| | |
|---|---|
| ***G08G 1/01*** | (2006.01) |
| ***G08G 1/052*** | (2006.01) |
| ***G08G 1/0967*** | (2006.01) |

(52) U.S. Cl.

CPC ..... *G08G 1/0129* (2013.01); *G08G 1/012* (2013.01); *G08G 1/0108* (2013.01); *G08G 1/0112* (2013.01); *G08G 1/0116* (2013.01); *G08G 1/0133* (2013.01); *G08G 1/0141* (2013.01); *G08G 1/052* (2013.01); *G08G 1/096716* (2013.01); *G08G 1/096758* (2013.01); *G08G 1/096775* (2013.01)

(58) Field of Classification Search

CPC .... G08G 1/0129; G08G 1/052; G08G 1/0108; G08G 1/096716; G08G 1/0141; G08G 1/0133; G08G 1/096758; G08G 1/0116; G08G 1/0112; G08G 1/096775; G08G 1/012

See application file for complete search history.

(56) References Cited

U.S. PATENT DOCUMENTS

| | | | | |
|---|---|---|---|---|
| 8,417,441 | B2 | 4/2013 | Kavaler et al. | |
| 2008/0004793 | A1* | 1/2008 | Horvitz | H04W 4/027 701/487 |
| 2013/0226442 | A1* | 8/2013 | Lynch | G01C 21/3694 701/119 |

(Continued)

FOREIGN PATENT DOCUMENTS

GB 2483094 A 2/2012

OTHER PUBLICATIONS

Chen, Anthony, Zhong Zhou, and William HK Lam. "Modeling stochastic perception error in the mean-excess traffic equilibrium model." Transportation Research Part B: Methodological 45.10 (2011): 1619-1640.*

(Continued)

*Primary Examiner* — Alan D Hutchinson

(74) *Attorney, Agent, or Firm* — Lempia Summerfield Katz LLC

(57) ABSTRACT

A method and apparatus for traffic modeling comprising: receiving by a server, traffic data generated by one or more devices configured to record data indicating speeds of vehicles traveling a road segment. The server separates, with a processor, the traffic data into zero speed data and non-zero speed data. The server determines, with the processor, a zero speed data characteristic value of the zero speed data. The server determines, with the processor, at least one non-zero speed data characteristic value of the non-zero speed data. The server generates, with the processor, a representative traffic value for the road segment as a function of the zero speed characteristic value and the non-zero speed characteristic value.

20 Claims, 10 Drawing Sheets

(56) References Cited

U.S. PATENT DOCUMENTS

2014/0005916 A1 1/2014 Shen et al.

OTHER PUBLICATIONS

Wikipedia article, Histogram, printed Aug. 3, 2016.*
Canaud et al., A Bayesian Approach to Real-Time Traffic State Estimation Using a Particle PHD Filter with Appropriate Clutter Intensity, Mar. 14, 2014, 92nd Transportation Research Board Annual Meeting.
Hofleitner et al., Learning the Dynamics of Arterial Traffic From Probe Data Using a Dynamic Bayesian Network, May 11, 2012, Intelligent Transportation Systems, IEEE Transactions on 13.4.
Lederman et al., Real-Time Traffic Estimation Using Data Expansion, 2011, Transportation Research Part B: Methodological 45.7.
Hofleitner et al., Probability Distributions of Travel Times on Arterial Networks: A Traffic Flow and Horizontal Queuing Theory Approach, Jan. 22-26, 2012, 91st Transportation Research Board Annual Meeting. No. 12-0798.
PCT International Search Report and Written Opinion of the International Searching Authority dated Jul. 21, 2016 for corresponding PCT/EP2016/063106.

* cited by examiner

FIG. 7A
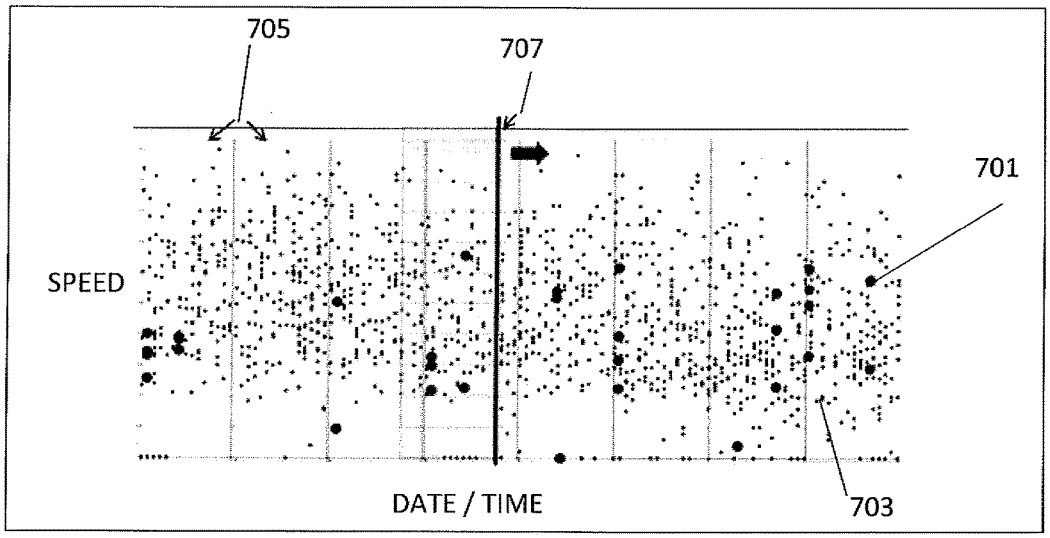
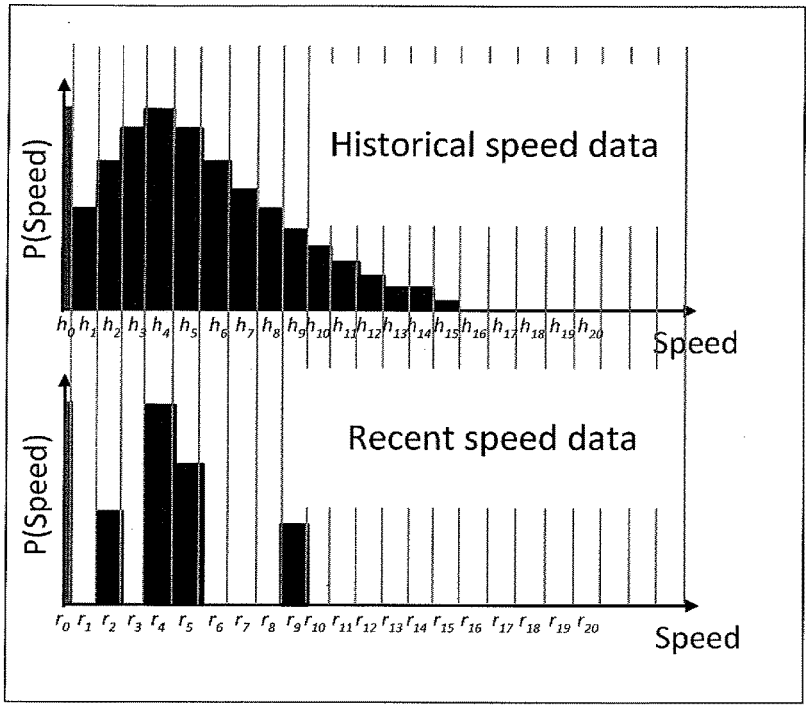
FIG. 7B

TRAFFIC SPEED MODELING

FIELD

The following disclosure relates to traffic speed modeling.

BACKGROUND

Road systems may involve collections of dozens, hundreds, or even thousands of individual roads or sections of road known as segments. A particular road system may have varying traffic densities, flows, events, or conditions in different geographic positions throughout the road system.

Accurate modeling of traffic speeds for all road segments is important to maintain most modern maps and to facilitate route planning software. Multiple applications and services depend on accurate traffic speed modeling. Updated traffic speed information is important to properly route vehicles and provide up to the minute estimated time of arrivals. Models should be able to take into consideration recent data, historical data, and/or vehicular behavior on multiple types of roads.

SUMMARY

In an embodiment, a server receives traffic data generated by one or more devices configured to record data indicating speeds of vehicles traveling a road segment. The server separates, with a processor, the traffic data into zero speed data and non-zero speed data. The server determines, with the processor, a zero speed data characteristic value of the zero speed data. The server determines, with the processor, at least one non-zero speed data characteristic value of the non-zero speed data. The server generates, with the processor, a representative traffic value for the road segment as a function of the zero speed characteristic value and the non-zero speed characteristic value.

In an embodiment, an apparatus comprising at least one processor and a memory including computer program code and operable to store traffic data generated by devices configured to record traffic data representing speeds of vehicles traveling a road segment. The at least one memory and the computer program code configured to, with the at least one processor, cause the apparatus at least to separate the traffic data into zero speed data and non-zero speed data, determine a zero speed characteristic value of the zero speed data, determine at least one non-zero speed characteristic value of the non-zero speed data, and generate a representative traffic value for the road segment as a function of the zero speed characteristic value and the non-zero speed characteristic value.

In an embodiment, a method comprising determining a location data value for a mobile device, sending the location data value to a server, and receiving a representative traffic data value from the server, wherein the representative traffic data value is generated by the server as a function of at least one zero speed data characteristic value from zero speed values and at least one non-zero speed data characteristic value of the non-zero speed data from nonzero speed values.

BRIEF DESCRIPTION OF THE DRAWINGS

Exemplary embodiments of the present invention are described herein with reference to the following drawings.

FIGS. 7A and 7B illustrate example traffic speed data and histograms.

DETAILED DESCRIPTION

A Gaussian (or normal) distribution is a very commonly occurring continuous probability distribution (i.e. a function that tells the probability that any real observation will fall between any two real limits or real numbers) as the curve approaches zero on either side.

The normal assumption is most valid for modeling traffic flow on highways where average speeds are high, and have relatively low variability. However, even there, a Gaussian distribution does not represent the constraint that speed be a positive value. This becomes significant during congested conditions, when average speed is low, because a normal distribution models a finite and large probability of segment travel times being below zero.

For non-limited access highways, a Gaussian distribution for traffic data points breaks down because on arterials and other secondary and tertiary roadways it is common for vehicles to be stationary for periods of time, even under free-flow conditions, and because speeds in a given direction on a segment of roadway cannot be negative. A more suitable model for arterial traffic speeds may be the mixture of a Dirac delta function at zero, with a Gamma distribution of continuous speeds greater than zero.

Figure 1:
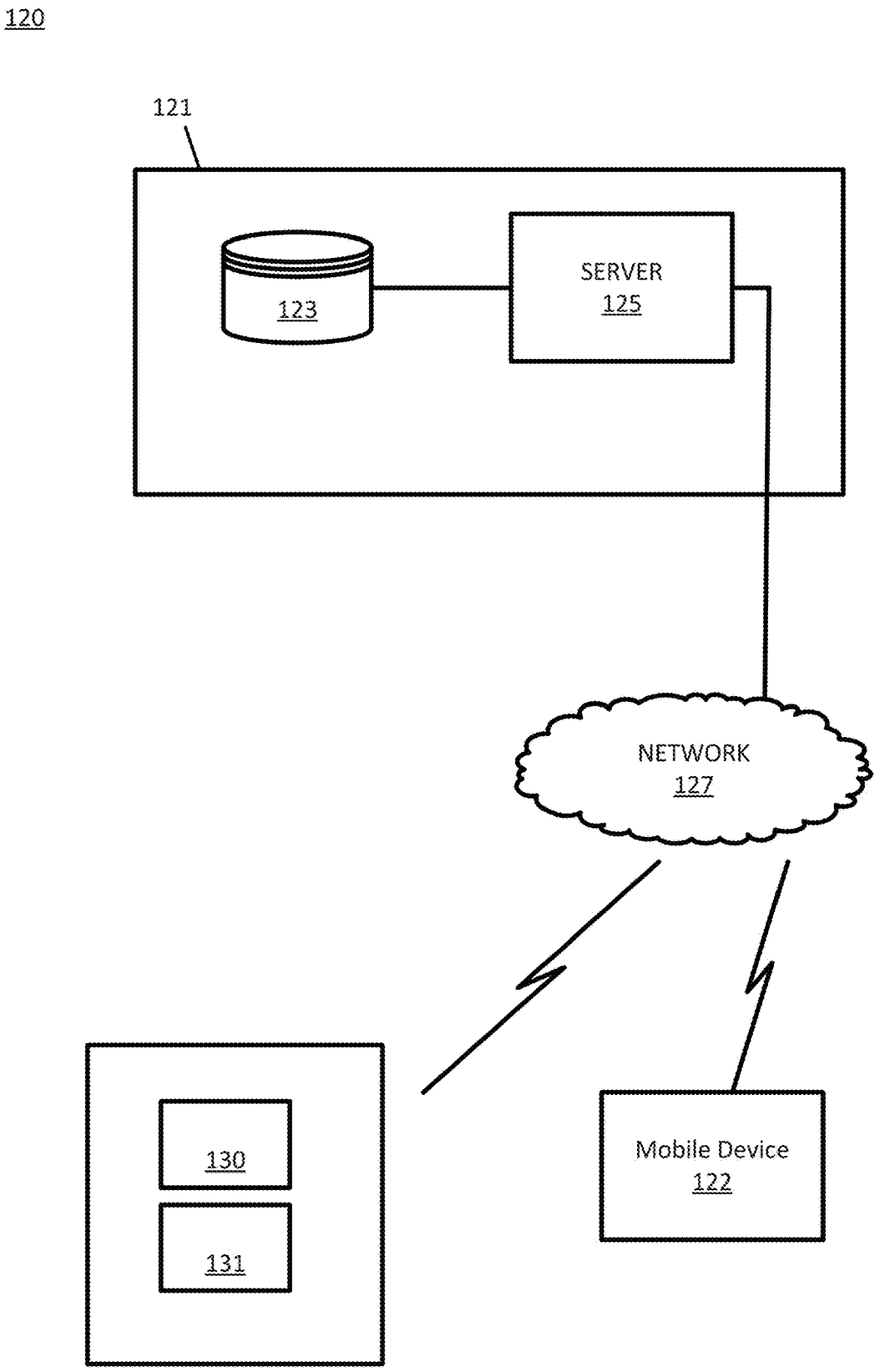
FIG. 1 illustrates an example system for modeling traffic speed.

FIG. 1 illustrates an example system for modeling traffic speeds. In FIG. 1, one or more probes 130, 131 and/or other sensors are connected to the server 125 though the network 127. A database 123 is also connected to the server 125. The database 123 and server 125 make up a navigation system 121. A mobile device 122 is connected to the server 125 through the network 127. Additional, different, or fewer components may be included.

The probe(s) 130, 131 may be a mobile device or a tracking device that provides samples of data for the location of a vehicle. The probe(s) 130, 131 may be mobile phones running specialized applications that collect location data as people travel roads as part of their daily lives. The probe(s) 130,131 may also be integrated in or with a vehicle.

Traffic speed data may also be collected with a sensor, or collection of sensors, such as an inductance loop or optical detector (e.g., camera, light detection and ranging (LiDAR), or radar device). The probe(s) 130, 131 and/or other sensor(s) may report the quantity, frequency, and/or speed of vehicles as they travel road segments. The road segment may be determined based on the geographical coordinates of the probe (e.g., global positioning system (GPS)).

The one or more probes 130, 131 and/or other sensor(s) may be designed to measure the volume, occupancy, and speed of a large percentage of vehicular traffic for a given point on a roadway. This might be for fleet tracking purposes, or anonymized data collection from cell phones. Generally, only a percentage of the total vehicle population may be available.

The network 127 may include wired networks, wireless networks, or combinations thereof. The wireless network may be a cellular telephone network, a wireless local area network, such as an 802.11, 802.16, 802.20, WiMax (Worldwide Interoperability for Microwave Access) network, or wireless short range network. Further, the network 127 may be a public network, such as the Internet, a private network, such as an intranet, or combinations thereof, and may utilize a variety of networking protocols now available or later developed including, but not limited to TCP/IP based networking protocols.

The term server is used herein to collectively include the computing devices in a navigation system 121 for creating, maintaining, accessing, and updating the traffic speed database(s) 123. The server 125 may be a host for a website or web service such as a mapping service and/or a navigation service. The mapping service may provide maps generated from the geographic data of the database 123, and the navigation service may generate routing or other directions from the geographic data of the database 123. Additional, different, or fewer components may be included.

The terms database and traffic speed database refer to a set of data or map data stored in a storage medium and may not necessarily reflect specific requirements as to the relational organization of the data or the map data. The database 123 may be a geographic database including road segments and road attributes. The database 123 may contain historical traffic speed data for each road segment.

Figure 2:
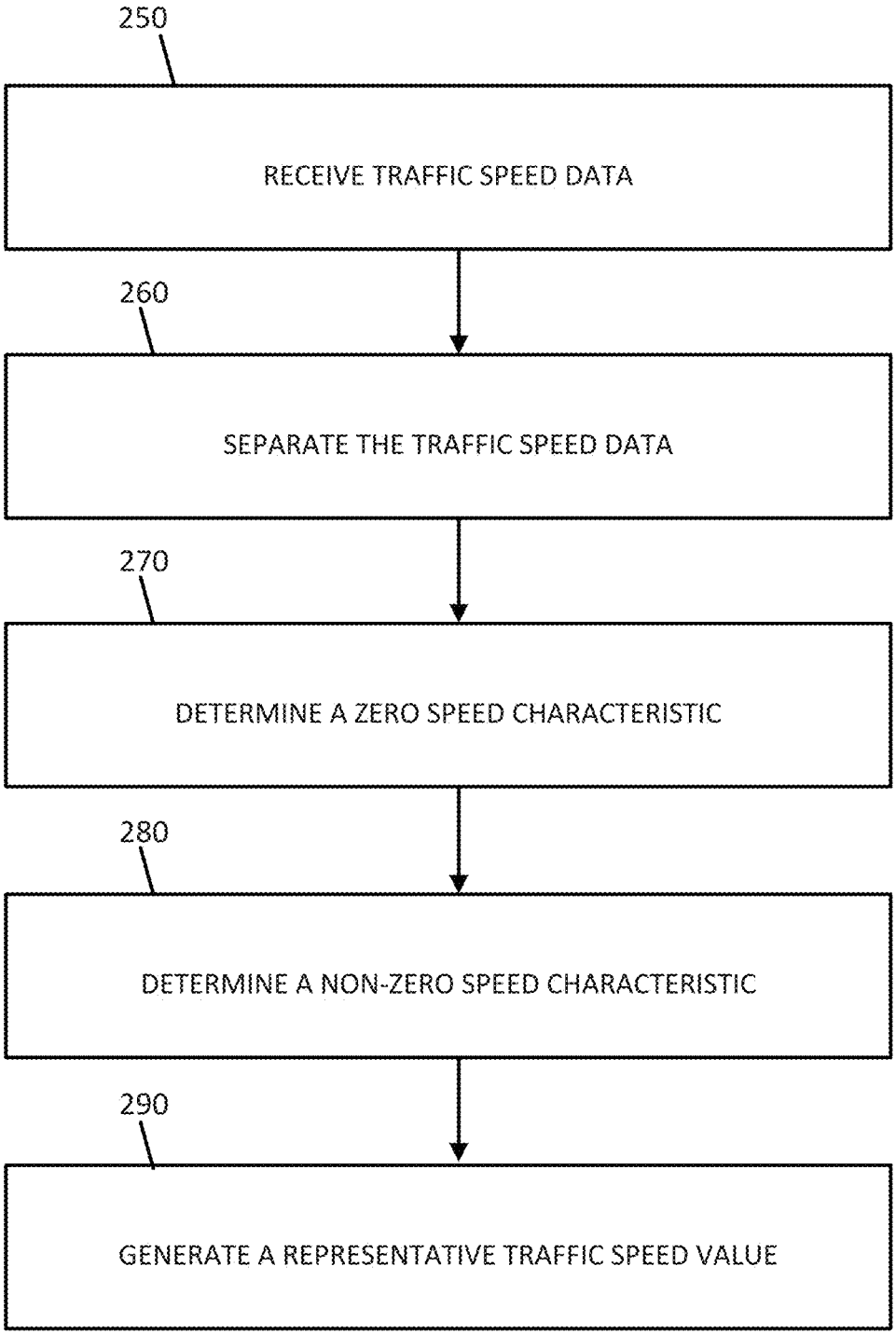
FIG. 2 illustrates an example method for modeling traffic speed.

FIG. 2 illustrates a flow chart of an example embodiment for modeling traffic speed. As presented in the following sections, the acts may be performed using any combination of the components indicated in FIG. 1, FIG. 8, or FIG. 9. The following acts may be performed by mobile device 122, server 125, or a combination thereof. Additional, different, or fewer acts may be provided. The acts are performed in the order shown or other orders. The acts may also be repeated.

At act 250, a server 125 receives traffic speed data generated by one or more devices 130,131 configured to record data indicating speeds of vehicles traveling a road segment. The traffic speed data may be one or more values that indicate a road segment identification, a speed of a vehicle, and a time the data point was recorded.

The traffic speed data may be generated by one or more devices 130, 131 such as one or more probes 130, 131 and/or other sensor(s). The probe(s) 130, 131*s* and/or other sensor(s) may also be designed to measure the volume, occupancy and speed of vehicular traffic for a given point on a road segment.

Traffic speed data may be represented according to individual road segments. A road segment may be data representing a length or piece of road. Road segments may be defined according to nodes or intersections. For example, a road segment may extend from one node to another node. In rural areas, road segments may be relatively large because the distances between intersections are lengthy. In urban areas, road segments may be relatively small because the distances between intersections are short.

Recent traffic speed data may be collected, perhaps for a period of one to fifteen minutes. This recent traffic speed data may be taken to be representative of the current situation on a roadway or road segment. Because of the limited time-frame of collection, the recent traffic speed data may be sparse. Data may also be aggregated over time, such that a historical data model of generalized vehicle traffic speed can be generated. This may be important to validate how representative the recent traffic speed data is, and correct a model as needed. The recent traffic speed data may also include recent speed data collected from mobile devices and/or vehicles currently traveling the roadway.

At act 260, the server 125 separates the traffic speed data into zero speed data and non-zero speed data. The zero speed data may include, for example, vehicles stopped at a traffic light or at a stop sign.

At act 270, the server 125 determines a zero speed data characteristic value of the zero speed data. The zero speed data characteristic value may be determined using any technique. The zero speed data characteristic value may be a probability that a vehicle is stopped. In an embodiment that uses the probability that a vehicle is stopped, the number of zero speed data points is the numerator and the number of total data points is the denominator.

At act 280, the server 125 determines at least one non-zero speed data characteristic value of the non-zero speed data. The non-zero speed data characteristic value may be determined using any technique. In an embodiment, to determine at least one non-zero speed data characteristic value, the server 125 may model a Delta-Gamma distribution of traffic flow speeds. Modeling the distribution of traffic flow speeds may require learning the parameters of a suitable model based on samples of speed information from vehicles traveling on those roadways over time. The server 125 may use Bayes' rule to help model the speed of vehicles.

The server 125 defines x to be the speed of a vehicle on a segment at a given time. The goal is to learn a set of model parameters, $\{\theta\}$ given a series of samples of x that maximize $p(\{\theta\}|\{x\})$. By Bayes' rule:

$$p(\{\theta\}\,|\,\{x\}) = \frac{p(\{x\}\,|\,\{\theta\})p(\{\theta\})}{p(\{x\})} \qquad \text{Equation 1}$$

The server 125 determines the posterior distribution, $p(\{\theta\}|\{x\})$. By observing the empirical distributions of speeds on arterial segments as shown in 5C, x may be generated from a distribution of the Delta-Gamma form which combines a spike in probability density at x=0 with a positive-skewed, nonnegative distribution of speeds above zero. Thus, the server 125 uses as a form for the posterior distribution, $p(x|\{\theta\})$:

$$p(x\,|\,\{\theta\}) = p(x\,|\,a, k, \omega) = a\delta(x) + (1-a)\frac{1}{\Gamma(k)}x^{k-1}e^{-\omega x} \qquad \text{Equation 2}$$

Where $\Gamma(k)$ is the Gamma function (continuous factorial) and $a\in[0,1]$, $k\in[1, +\infty]$, $\omega\in[0, +\infty]$ represent the parameters to be estimated. To clarify:

a is probability of zero speed vehicles (eg. % of cars stopped at the "light")

x is the speed of a vehicle (km/h) on a segment at a point in time.

k and ω are not interpretable, although the two can be converted into the mean and variance of the gamma distribution via a change of variables.

The Priors, $p(\{\theta\})$, over the parameters may be separated into two elements; the first, the prior on a, which since a simply represented the probability of x being exactly equal to zero is a Bernoulli distribution for which the conjugate prior is Beta(α,β) where $$\alpha = 1 + \text{number of zero speeds}, \beta = 1 + \text{number of nonzero speeds.}$$

The second is the gamma distribution over non-zero speeds for which the conjugate prior has the form:

$$p(k, \omega) \sim \frac{p^{k-1}e^{-\omega q}}{\Gamma(k)^r \omega^{-ks}} \quad \text{Equation 3}$$

so that:

$$\log p(k, \omega) = \log(p^{k-1}e^{-\omega q}) - \log(\Gamma(k)^r \omega^{-ks}) + \text{Constant} = (k-1)\log p - \omega q - r\log\Gamma(k) + ks\log\omega + \text{Constant} \quad \text{Equation 4}$$

Which has optima where $$\frac{\partial \log p(k, \omega)}{\partial k} = 0 \text{ and } \frac{\partial \log p(k, \omega)}{\partial \omega} = 0;$$

$$\frac{\partial \log p(k, \omega)}{\partial k} = \log p - \frac{r}{\Gamma(k)}\frac{\partial \Gamma(k)}{\partial k} + s\log\omega \quad \text{Equation 5}$$

$$\frac{\partial \log p(k, \omega)}{\partial \omega} = -q + \frac{ks}{\omega} \quad \text{Equation 6}$$

So that:

Log Posterior:

$$\log p(x|k,\omega) = (k-1)\log x - \omega x - \log \Gamma(k) \quad \text{Equation 7:}$$

Given this model, the server 125 can decompose the Bayesian Estimation problem into two steps, firstly updating the hyper parameters for a:

$$\alpha \leftarrow \alpha + \Sigma_{i=1}^{n} x_{bin}^{(i)}, \beta \leftarrow \beta + n - \Sigma_{i=1}^{n} x_{bin}^{(i)}, \quad \text{Equation 8:}$$

Where $x_{bin}$ is an indicator variable specifying whether x=0.

Then updating the hyper parameters for k,ω as follows, as additional samples of x arrive:

$$p \leftarrow p \prod_{i \in x^{(i)}=0} x^{(i)}$$

$$q \leftarrow q + \sum_{i \in x^{(i)}=0} x^{(i)}$$

$$r \leftarrow r + n - \sum_{i=1}^{n} x_{bin}^{(i)}$$

$$s \leftarrow s + n - \sum_{i=1}^{n} x_{bin}^{(i)}$$

At act 290, the server 125 generates a representative traffic value for the road segment. The server 125 may use Bayes' rule to estimate a representative traffic value using the zero speed characteristic value and the non-zero characteristic value.

These update rules may be modified to incorporate time windowing information, and the blending of long-term historical data, recent historical data and recent time-window data points depending on the application of the estimate, which the server 125 performs below.

In this embodiment, recent or near-recent data points (within some time window, τ) may be scarce. As a result, the available recent data may be blended with time-of-day, day-of-week historical estimates of conditions. FIG. 7A illustrates historic windows and recent windows with 15 minute periods. Other time periods (e.g., 30 minutes, 1 hour, 2 hours, 12 hours, 1 day or others) may be substituted for the 15 minute epochs. Multiple time periods may be used depending on geography (e.g., rural versus urban) or time (e.g., night versus day). Blending the recent data with historical data essentially means that for a given epoch (period) the server 125 may adapt the updated rules above according to the following strategy.

A new estimate of recent conditions on a segment may be computed every epoch, using all data points received within an adjustable time window, τ. Each estimate comprises three components; the parameters of the historical distribution for a current epoch, the previous estimated parameters for a previous epoch of recent estimation and the current epoch.

$$p_t^{(epoch)} \prod_{i \in x^{(i)}=0} x^{(i)}$$

$$q_{t+1} \leftarrow q_{t+1}^{(hist)} + q_t^{(epoch)} + \sum_{i \in x^{(i)}=0} x^{(i)}$$

$$r_{t+1} \leftarrow r_{t+1}^{(hist)} + r_t^{(epoch)} + n - \sum_{i=1}^{n} x_{bin}^{(i)}$$

$$s_{t+1} \leftarrow s_{t+1}^{(hist)} + s_t^{(epoch)} + n - \sum_{i=1}^{n} x_{bin}^{(i)}$$

And for hyper parameters of the prior for the Bernoulli distribution:

$$\alpha \leftarrow \alpha^{(hist)} + \alpha^{(epoch)} + \sum_{i=1}^{n} x_{bin}^{(i)},$$

$$\beta \leftarrow \beta^{(hist)} + \beta^{(epoch)} + n - \sum_{i=1}^{n} x_{bin}^{(i)}$$

An optimal ratio for recent to historical data may be refined over time as the traffic speed modeling becomes clear. The server 125 may contain separate specific ratios or recent to historical data that deliver the greatest accuracy and stability in light of the road segment attributes and environment. Time of day and/or day of week matching may be specific enough to allow for traffic speed monitoring even when there is little to no recent data available for certain road segments. In another embodiment, metadata for each road segment and traffic speed estimation may be stored in the database so that road segments may be grouped and analyzed per certain road attributes. Certain road segments may follow similar traffic speed estimates even with few or no recent data points.

In addition to weighting historical data versus recent data, other model parameters may be adjusted to maximize accuracy. Different sets of data may be collected to produce a model. Such parameters as Recent Window, Recent Data weight (mentioned above), or minimum Recent data points may be adjusted upwards or downwards.

One example is to set these parameters as follows:

Recent Weight=1

Minimum Recent points=2

Recent window size in minutes=15

Another example is:

Recent Window (minutes): 15

Recent Weight: 1-3

Recent Data Points: 1

These parameters may be tuned by using ground truth data and validation data. Ground truth data is data acquired from specific vehicles driven with the flow of traffic. Validation data is data that is not sampled for use in the model. The purpose of both validation and ground truth data is to act as a benchmark to compare with the model's predicted results. Ideally, one would want to use all of the ground truth data as a benchmark. However, the amount of ground truth data is limited. As a result, it is necessary to sample from the recent data to represent the ground truth. Therefore, a resampling strategy is applied to produce the validation data set.

In another embodiment, the server 125 performs maximum likelihood rather than full Bayesian estimation. In this approach, the server 125 directly estimates a by computing the percentage of zero speeds of a weighted combination of historical data for the epoch and the recent data in the corresponding time window. Then the server 125 uses a maximum-likelihood estimation to estimate the Gamma Distribution parameters k, w based on the non-zero data points in the combination. This embodiment may reduce the computational complexity of performing a full Bayesian estimation.

Figure 3:
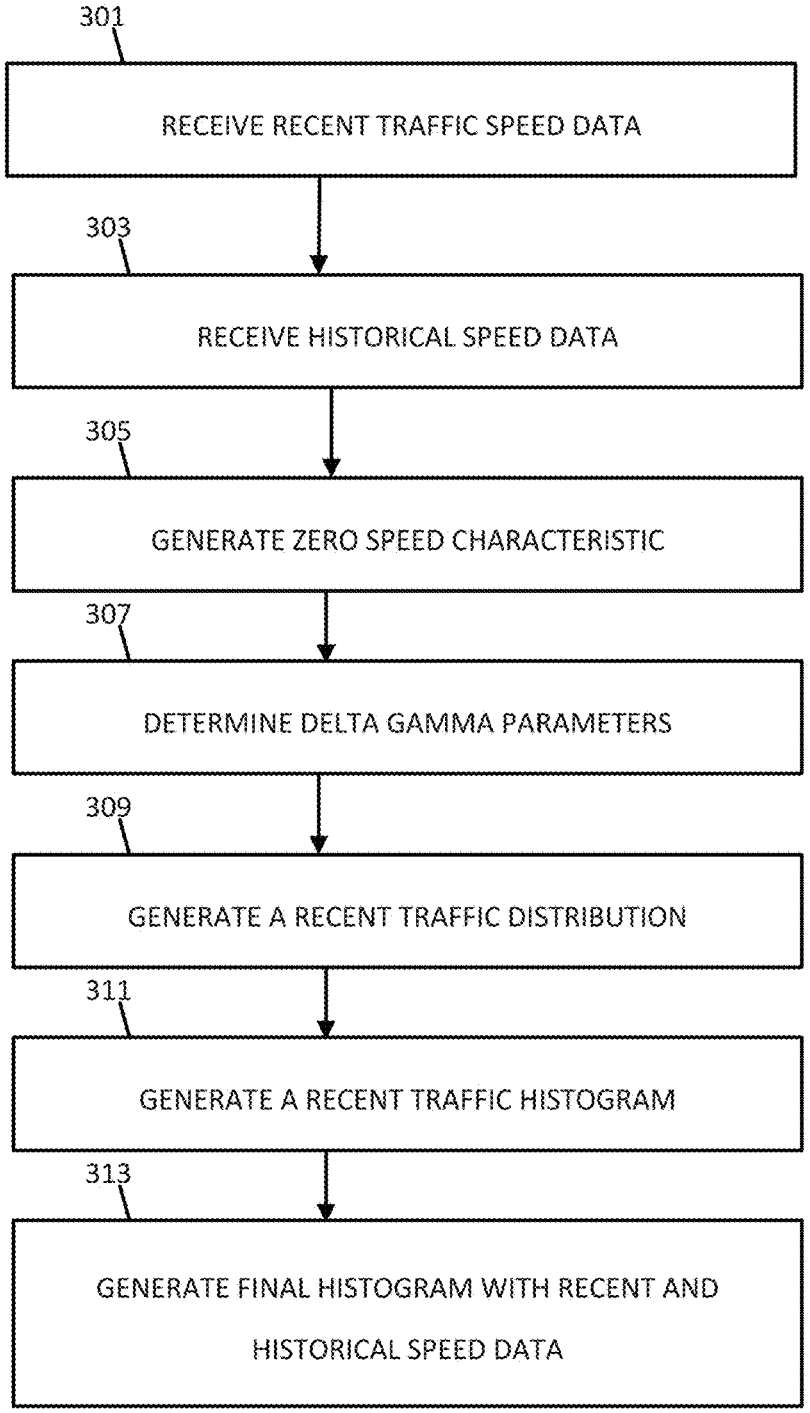
FIG. 3 illustrates an example method for modeling traffic speed using histograms.

FIG. 3 illustrates a flow chart of an example embodiment for modeling traffic speed. As presented in the following sections, the acts may be performed using any combination of the components indicated in FIG. 1, FIG. 8, or FIG. 9. The following acts may be performed by mobile device 122, server 125, or a combination thereof. Additional, different, or fewer acts may be provided. The acts are performed in the order shown or other orders. The acts may also be repeated.

In certain embodiments, the probabilistic model may be supplemented with a histogram which also incorporates the delta function. A histogram may be used as representation of the traffic speed data. A histogram is an estimate of the probability distribution of the traffic speed data.

At act 301, a server 125 receives recent traffic speed data from one or more devices 130, 131 configured to record data indicating speeds of vehicles traveling a road segment. The recent traffic speed data may be a collection of data including values for speed, data/time, and a road segment identification.

At act 303, the server 125 receives historical traffic speed data from a database 123. The historical traffic speed data may include values for speed, data/time, and a road segment identification. The historical traffic speed data may be formatted into a histogram containing separate buckets for one or more speed bins. This distribution may be called the historical traffic speed Delta-Histogram. In this embodiment, an empirical delta-histogram may contain 21-bins as follows:

[0], [0.5 kph], [5 kph,10 kph], [10 kph,15 kph], [15 kph,20 kph], [20 kph,25 kph],
[25 kph,30 kph], [30 kph,35 kph], [35 kph,40 kph], [40 kph,45 kph], [45 kph,50 kph],
[50 kph,55 kph], [55 kph,60 kph], [60 kph,65 kph], [65 kph,70 kph], [70 kph,75 kph],
[75 kph,80 kph], [80 kph,85 kph], [85 kph,90,kph], [90 kph,95 kph], [95 kph+]

In certain embodiments, the database 123 will also store the Delta-Gamma parameter(s) for the historical traffic speed data. The database 123 may store these parameter(s) in association with the road segment identifications. In such an embodiment, the parameters would not have to be recalculated each time the historical traffic speed data was used. In certain embodiments, the database 123 may only store the histogram values for the historical traffic speed data.

At act 305, the server 125 generates the percentage of zero speeds in the recent traffic speed data. The percentage is a function of the amount of zero speed data points versus the amount of total traffic speed data points.

At act 307, the server 125 determines gamma distribution parameters based on one or more non-zero data points in the recent traffic speed data. The gamma distribution parameters may be converted into the mean and variance of the gamma distribution via a change of variables.

At act 309, the server 125 generates a recent traffic distribution using the percentage of zero speeds and the gamma distribution parameters. The representative traffic model may estimate the speed of a vehicle on a road segment at a point in time.

At act 311, the server 125 generates a recent traffic speed data histogram using the one or more recent speed values. The recent traffic speed data histogram may contain 21-bins as follows:

[0], [0.5 kph], [5 kph,10 kph], [10 kph,15 kph], [15 kph,20 kph], [20 kph,25 kph], [25 kph,30 kph],
[30 kph,35 kph], [35 kph,40 kph], [40 kph,45 kph], [45 kph,50 kph], [50 kph,55 kph],
[55 kph,60 kph], [60 kph,65 kph], [65 kph,70 kph], [70 kph,75 kph], [75 kph,80 kph],
[80 kph,85 kph], [85 kph,90,kph], [90 kph,95 kph], [95 kph+]

At act 313, the server 125 generates the final delta histogram using the recent traffic speed data histogram and the historical traffic speed data histogram. To compute the overall estimate of current traffic conditions, the recent traffic speed data histogram and the historical traffic speed histograms may be combined into a single distribution, with recent to historical weighting, as follows:

$$v_i = \frac{w}{1+w} r_i + \frac{1}{1+w} h_i \qquad \text{Equation 9}$$

Where $v_i$ is the output histogram speed count for bucket I; $r_i$ is the recent speed count for bucket i from the Delta-Gamma window; $h_i$ is the historic speed count for bucket i from the appropriate Delta-Gamma epoch; w is a weighting factor tuned per model tuning.

In certain embodiments, the server 125 may allow the combination of path data (connected segments of at least two data points) and single probe point data (single GPS location, velocity data points that cannot be successfully connected) for recent reasoning about speed on a given segment. Using the Delta-Gamma histogram, the server 125 may first generate the speed histograms for both the path and single recent data points separately. If there is path data, the single point data may be ignored. If there is a lack of path data, the single point data may be combined with the recent path data and/or the historic path data into a single hybrid recent delta-histogram.

Figure 4A:
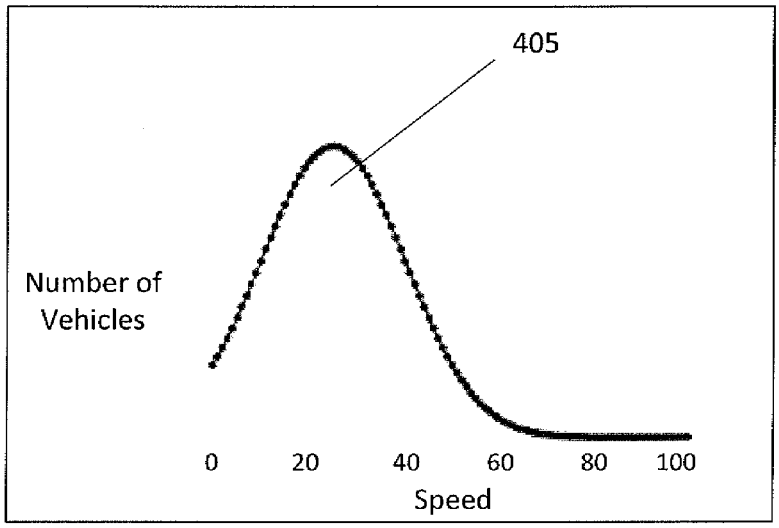
FIGS. 4A-C illustrate an example traffic speed model for free flowing traffic.
Figure 4B:
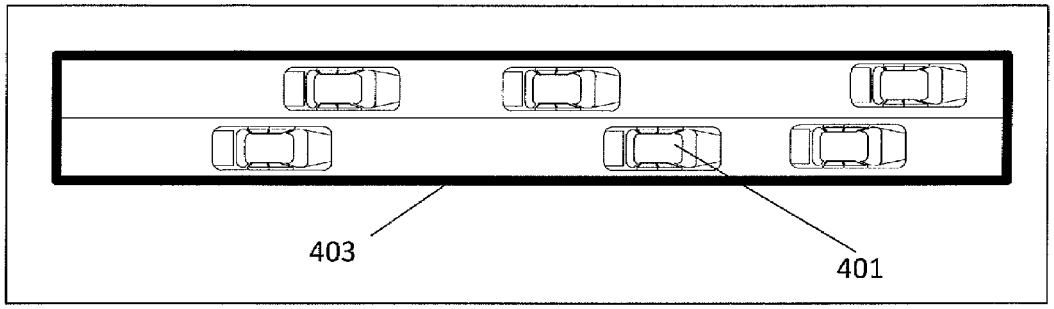
Figure 4C:
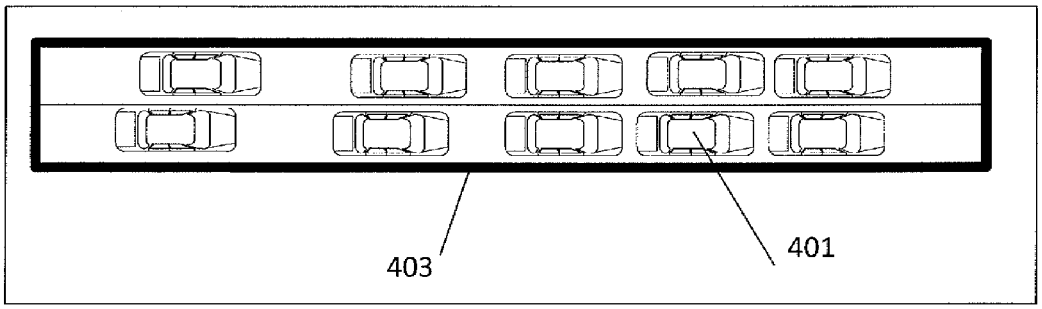

FIGS. 4A-C illustrate a traffic speed model for free flowing traffic. FIG. 4B illustrates free flowing traffic on a segment of a highway 403 or freeway with a number of vehicles 401 traveling from left to right. The distribution of speeds may be illustrated by a Gaussian distribution as shown in FIG. 4A. FIG. 4A is a Gaussian distribution with speed (X Axis) of the vehicles 401 and number of vehicles (Y axis). The distribution of vehicle speeds will tend to bunch around a peak 405 of the curve. This peak will generally be centered on an expected speed for the roadway at the free flowing condition, if there is free flowing traffic. Vehicles speeds may drop, but they will generally drop for every vehicle on the roadway. FIG. 4C illustrates a fully congested segment of a roadway. Collected speeds here will be close to zero which may still be represented by a Gaussian distribution with a peak near zero.

Figure 5A:
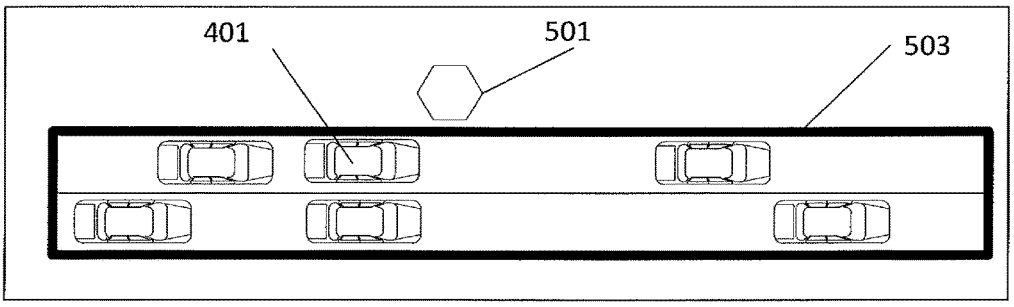
FIGS. 5A-C illustrate an example traffic speed model for arterial traffic.
Figure 5B:
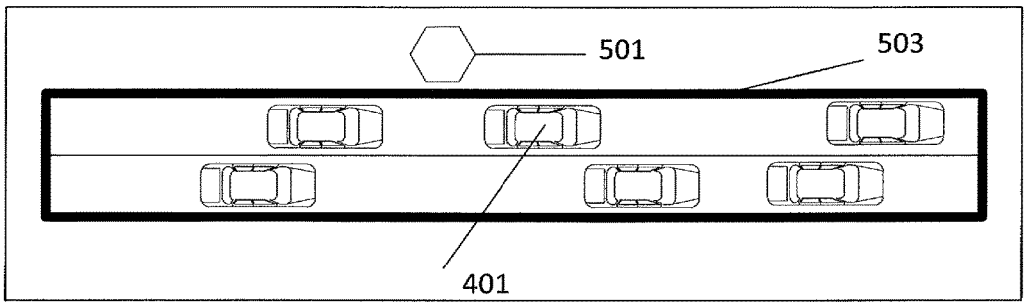
Figure 5C:
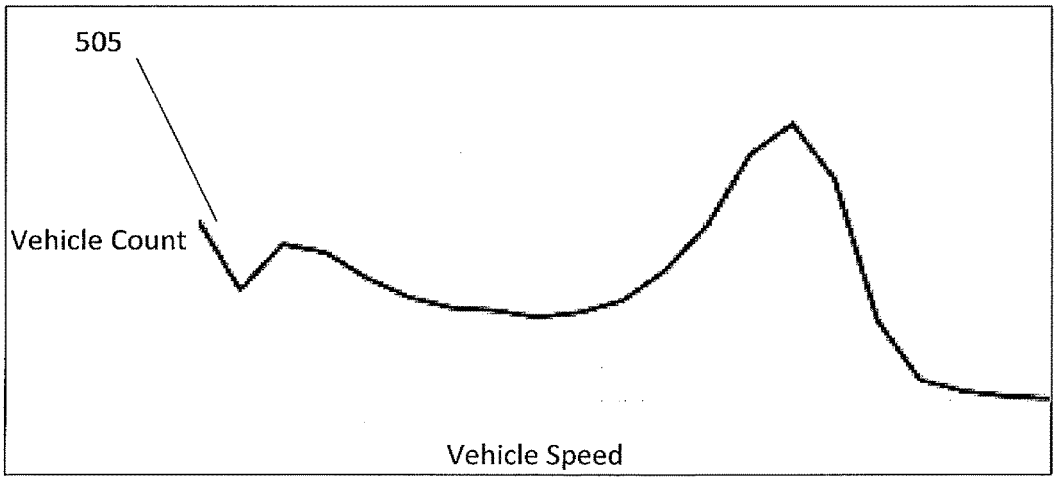

FIGS. 5A-C illustrate a traffic speed model for arterial traffic. FIGS. 5A and 5B illustrate vehicle 401 traffic on an arterial road 503. In FIGS. 5A and 5B, there are stop signs 501. In FIG. 5A, each vehicle 401 comes to a complete stop (zero speed). In FIG. 5B, after the stop sign 501, the vehicle(s) 401 may return to the vehicle(s)' previous speed. In FIG. 5A, there are three vehicles that have reached zero speed at the stop sign. Under a situation where there was not a stop sign, an observer of the traffic speed data might determine that there was heavy congestion (at least 3 out of 6 vehicles show zero speed). This would be an inaccurate representation of the road. Because of the stop sign 501, zero speeds are to be expected. FIG. 5C shows actual traffic speed data that was collected over a large period of time on one or more arterial roads. There is a significant uptick 505 in collected speeds at or around the zero speed bucket due to expected stops.

Figure 6A:
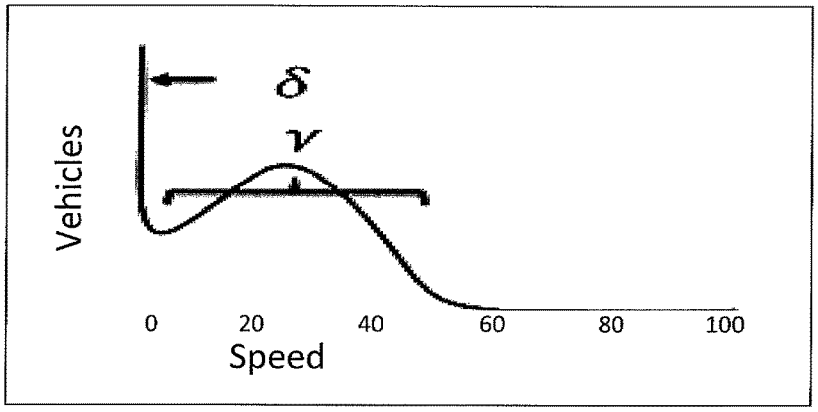
FIG. 6A-C illustrate a Delta-Gamma distribution for arterial traffic.
Figure 6B:
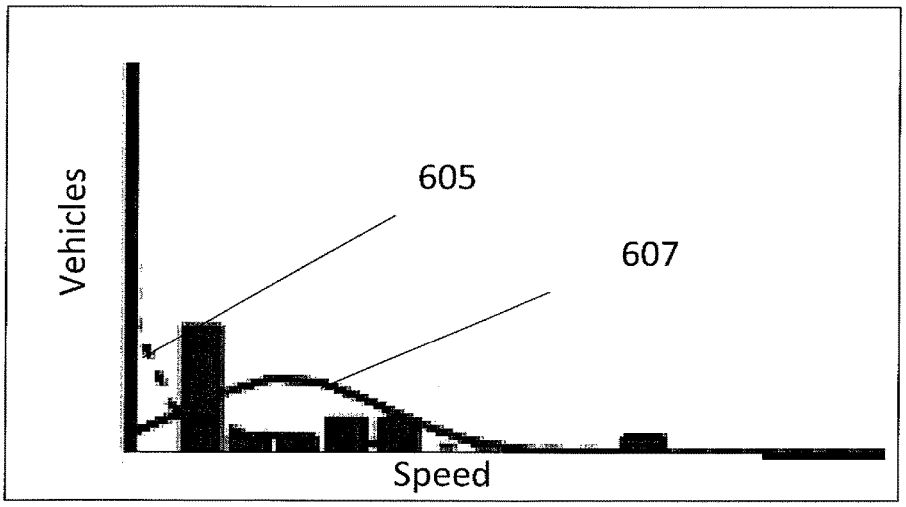
Figure 6C:
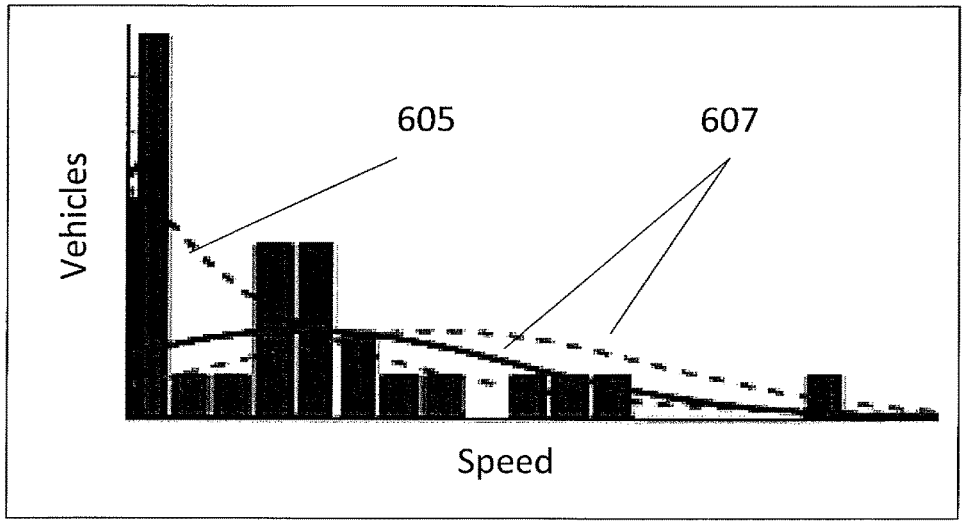

FIG. 6A illustrates a Delta-Gamma distribution for arterial traffic. The Delta-Gamma distribution models arterial traffic more optimally due to it taking into effect the increase in expected zero speed vehicles. FIGS. 6B and 6C illustrate empirical data (histograms), Delta-Gamma fit 605 and Gaussian fits 607 to (A) a speed greater than zero data set and (B) a speed greater than five data set. The roadway segment are a stop sign impeded segment and a stop light-impeded arterial roadway segment. In both cases the Delta-Gamma fit accommodates the significant percentage of zero data points in the empirical data (histogram bars), which the two Gaussian fits ignore. The Gaussian Fit distributions are truncated at zero (0). In terms of the computed speed values both (A) and (B) Gaussian fits significantly incorrectly estimates the speed of traffic flow on the segments, whereas the simple mean of all recent speeds (including zeros) somewhat underestimates the average speed. The stop sign impeded roadway in the epoch considered shows a significantly higher percentage of zero speeds than the stop light impeded roadway in the epoch illustrated here.

FIGS. 7A-C illustrate traffic speed data and a histogram. In an embodiment using a histogram approach, the server 125 maintains the Delta-Histogram distribution of the historical data for a segment-epoch, instead of the raw data. This embodiment mitigates the need to propagate the historical raw data points for every link-epoch and the need for the iterative algorithm; by replacing the explicit Delta-Gamma probabilistic model with an empirical histogram and incorporating a Delta function. FIG. 7A illustrates an example of traffic speed data received. Recent speed data is shown with a large dot 701. Historical traffic speed data is shown as a small dot 703. The graph may be split into 15 minute epochs (periods). The data may be sorted by the epochs into historical 705 and recent 707.

From the traffic speed data (illustrated in FIG. 7A), the server may be able to use a Delta-Gamma function to create histograms such as those in FIG. 7B. In FIG. 7B, the traffic speed data has been separated into a histogram for both historical speed data and recent speed data. In FIG. 7B, the histograms do not contain the same amount of data as recent speed data may be more sparse than historical speed data.

Figure 8:
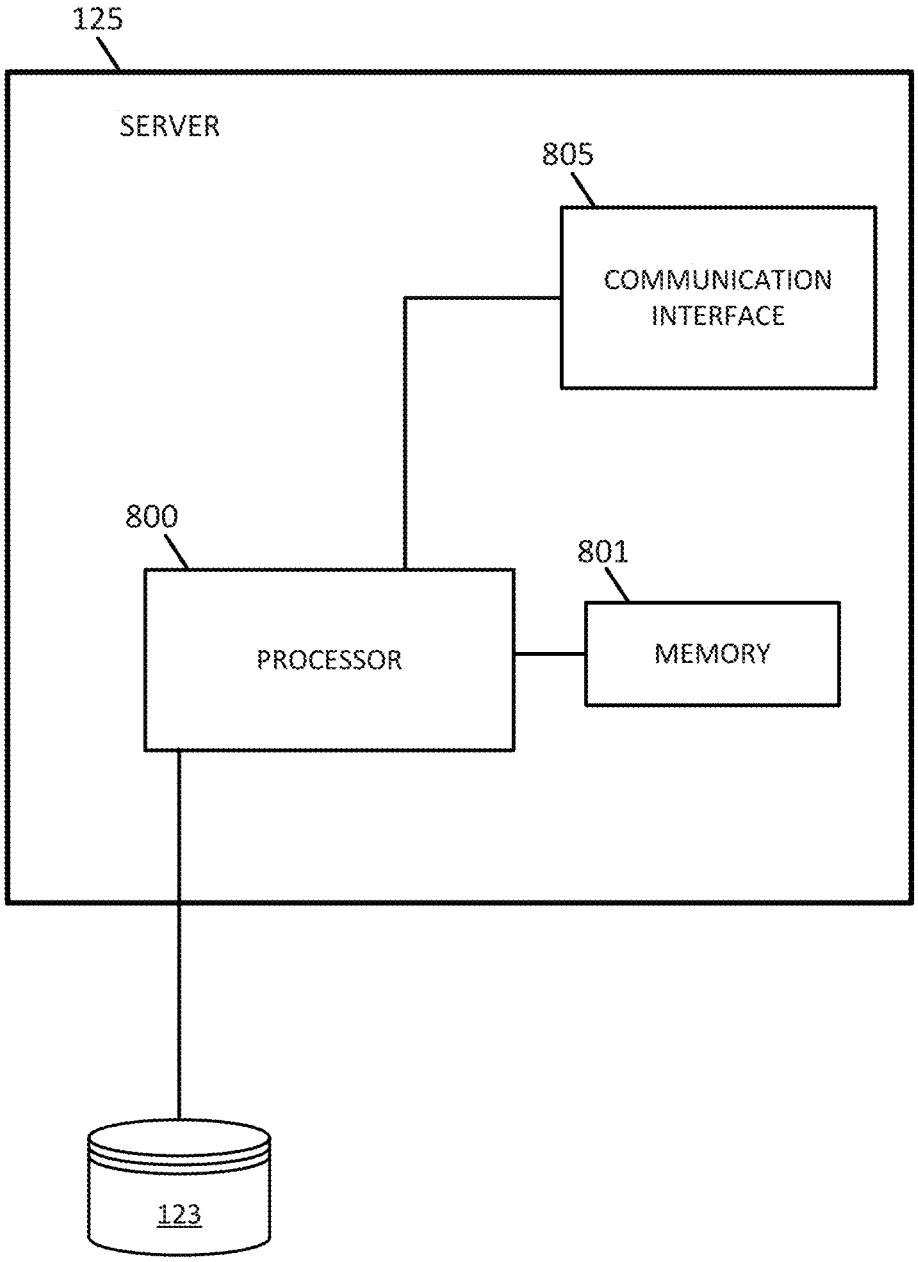
FIG. 8 illustrates an example server.

FIG. 8 illustrates an example server 125. The server 125 includes a processor 800, a communication interface 805, and a memory 801. The server 125 may be coupled to a database 123. Additional, different, or fewer components may be provided in the server 125.

The server 125 may be a host for a website or web service such as a mapping service and/or a navigation service. The mapping service may provide maps generated from the geographic data of the database 123, and the navigation service may generate routing or other directions from the geographic data of the database 123. The mapping service may also provide traffic information generated from historical traffic speed data included in the database 123. Historical traffic speed data may be stored with each road segment. The server 125 may also provide recent or current traffic conditions using the representative traffic value. As mentioned above, historical and recent traffic speed data may be blended to produce a more accurate traffic speed value. This may be necessary where there are little to no recent data collected.

The communication interface 805 may be configured to receive mobile device data representing locations and movements of a plurality of mobile devices 122. The processor 800 may be configured to calculate traffic speed data for segments of road. In an embodiment, the processor 800 is configured to calculate probabilities of vehicle speed and vehicle speed values for road segments. As such, the processor 800 is configured to determine a probability of vehicle speed of road segments of a road network the road network involving a plurality of road segments using historical speed data or recent speed data. The processor 800 is configured to provide an indication of the calculated current traffic speed of the road segments.

The controller 200 and/or processor 800 may include a general processor, digital signal processor, an application specific integrated circuit (ASIC), field programmable gate array (FPGA), analog circuit, digital circuit, combinations thereof, or other now known or later developed processor. The controller 200 and/or processor 800 may be a single device or combinations of devices, such as associated with a network, distributed processing, or cloud computing.

The memory 204 and/or memory 801 may be a volatile memory or a non-volatile memory. The memory 204 and/or memory 801 may include one or more of a read only memory (ROM), random access memory (RAM), a flash memory, an electronic erasable program read only memory (EEPROM), or other type of memory. The memory 204 and/or memory 801 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The database 123 may include geographic data used for traffic and/or navigation-related applications. The geographic data may include data representing a road network or system including road segment data and node data. The road segment data represent roads, and the node data represent the ends or intersections of the roads. The road segment data and the node data indicate the location of the roads and intersections as well as various attributes of the roads and intersections. Other formats than road segments and nodes may be used for the geographic data. The geographic data may include structured cartographic data or pedestrian routes.

The database 123 may also include other attributes of or about the roads such as, for example, geographic coordinates, street names, address ranges, speed limits, turn restrictions at intersections, and/or other navigation related attributes (e.g., one or more of the road segments is part of a highway or toll way, the location of stop signs and/or stoplights along the road segments), as well as points of interest (POIs), such as gasoline stations, hotels, restaurants, museums, stadiums, offices, automobile dealerships, auto repair shops, buildings, stores, parks, etc. The database 123 may also contain one or more node data record(s) which may be associated with attributes (e.g., about the intersections) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data may additionally or alternatively include other data records such as, for example, POI data records, topographical data records, cartographic data records, routing data, and maneuver data.

The database 123 may include historical traffic speed data for one or more road segments. The database 123 may also include traffic attributes for one or more road segments. A traffic attribute may indicate that a road segment has a high probability of traffic congestion.

The server 125 may overlay traffic information on a map provided by the database. Traffic information may be indicated by any technique. For example, colors and/or patterns are used to indicate traffic speed levels. In an embodiment, traffic speed is indicated using a plateaued threshold reporting scheme. For example, a series of traffic flow thresholds may be established such that a traffic speed value for a segment falls into a category defined by traffic speed threshold category boundaries. Each traffic speed threshold category may be indicated differently. For example, a segment having a high traffic speed category may be presented to a user differently than a segment having a low traffic speed category. Any indication that differentiates the different traffic flow levels may be used. In an embodiment, colors may be used for characterizations of traffic flow, and indicating the different traffic flow level comprises using different colors for a first segment and a second segment. Varying patterns or other indications may also be used to indicate different traffic levels for segments. In an embodiment, a congestion factor may be used to determine values for traffic level categories. For example, a heavy traffic category may have a congestion factor value between 0 and 10%. A moderately heavy traffic category may have a congestion factor value between 10% and 30%. A moderate traffic category may have a congestion factor between 30% and 80%, and a light or free flow traffic category may have a congestion factor between 80% and 100%. Any number of levels or categories may be provided.

Figure 9:
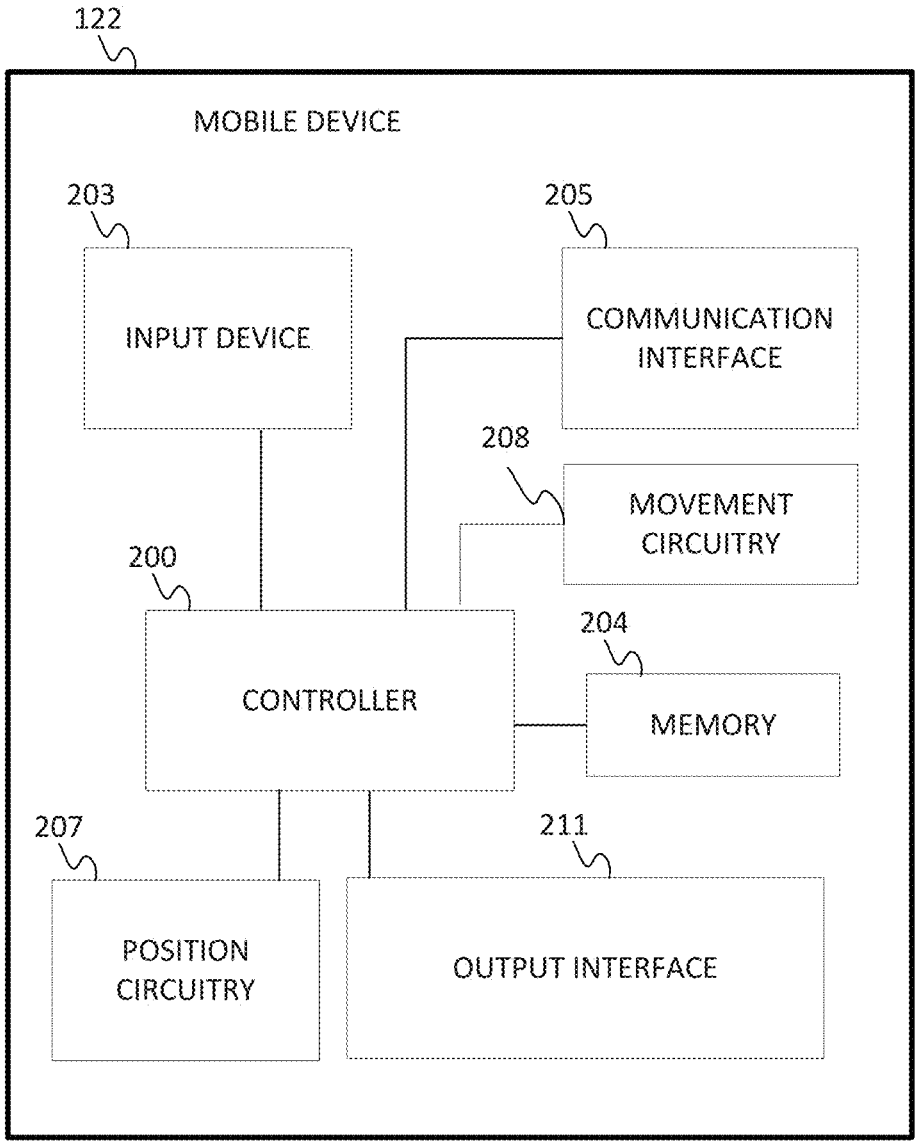
FIG. 9 illustrates an example mobile device.

Different indications of traffic information for various road segments may be provided to a mobile device 122, such as a mobile device 122 described below with respect to FIG. 9. The mobile device 122 may be provided a visible representation of the traffic levels. Different graphics may be used for different traffic levels. For example, the segments or lengths of road having different traffic levels are presented in different colors, instead of a singular color for the entire length of road.

The server 125 may use the traffic speed data for each road segment in a routing service. The server 125 through the network 127 may be in contact with a mobile device 122. The mobile device 122 may then use this traffic information to plan a route through a road system, or modify a current route through a road system. Updating the road segments most likely to be congested more often presents an accurate view of the probable traffic state for a mobile device 122 at any given time.

The network 127 may include wired networks, wireless networks, or combinations thereof. The wireless network may be a cellular telephone network, a wireless local area network, such as an 802.11, 802.16, 802.20, WiMax (Worldwide Interoperability for Microwave Access) network, or wireless short range network. Further, the network 127 may be a public network, such as the Internet, a private network, such as an intranet, or combinations thereof, and may utilize a variety of networking protocols now available or later developed including, but not limited to TCP/IP based networking protocols.

The mobile device 122 may be referred to as a navigation device. The mobile device may also be used as one or more probes 130, 131 or sensor(s). The mobile device 122 includes a controller 200, a memory 204, an input device 203, a communication interface 205, position circuitry 207, movement circuitry 208, and an output interface 211. The output interface 211 may present visual or non-visual information such as audio information. Additional, different, or fewer components are possible for the mobile device 122. The mobile device 122 is a smart phone, a mobile phone, a personal digital assistant (PDA), a tablet computer, a notebook computer, a personal navigation device (PND), a portable navigation device, and/or any other known or later developed mobile device. In an embodiment, a vehicle may be considered a mobile device, or the mobile device may be integrated into a vehicle.

The mobile device 122 may be configured to execute routing algorithms to determine an optimum route to travel along a road network from an origin location to a destination location in a geographic region. Using input(s) including traffic speed data from the server 125, a mobile device 122 examines potential routes between the origin location and the destination location to determine the optimum route. The navigation device 122 may then provide the end user with information about the optimum route in the form of guidance that identifies the maneuvers required to be taken by the end user to travel from the origin to the destination location. Some mobile device 122 show detailed maps on displays outlining the route, the types of maneuvers to be taken at various locations along the route, locations of certain types of features, and so on.

The mobile device 122 may be integrated into an autonomous vehicle or a highly assisted driving (HAD) vehicle. The mobile device 122 may be configured as a navigation system for an autonomous vehicle or a HAD. An autonomous vehicle or HAD may take route instruction based on the traffic speed data provided to the mobile device 122.

As described herein, an autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes.

As described herein, a highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible.

The autonomous or highly automated driving vehicle may include sensors for identifying the surrounding and location of the car. The sensors may include GPS, light detection and ranging (LIDAR), radar, and cameras for computer vision. Proximity sensors may aid in parking the vehicle. The proximity sensors may detect the curb or adjacent vehicles. The autonomous or highly automated driving vehicle may optically track and follow lane markings or guide markings on the road.

The positioning circuitry 207, which is an example of a positioning system, is configured to determine a geographic position of the mobile device 122. The movement circuitry 208, which is an example a movement tracking system, is configured to determine movement of a mobile device 122. The position circuitry 207 and the movement circuitry 208 may be separate systems, or segments of the same positioning or movement circuitry system. In an embodiment, components as described herein with respect to the mobile device 122 may be implemented as a static device. For example, such a device may not include movement circuitry 208, but may involve a traffic or speed detecting input device 203 such as a Doppler radar velocity detector or a contact sensing traffic volume measurement apparatus.

The input device 203 may be one or more buttons, keypad, keyboard, mouse, stylist pen, trackball, rocker switch, touch pad, voice recognition circuit, or other device or component for inputting data to the mobile device 122. The input device 203 and the output interface 211 may be combined as a touch screen, which may be capacitive or resistive. The output interface 211 may be a liquid crystal display (LCD) panel, light emitting diode (LED) screen, thin film transistor screen, or another type of display. The output interface 211 may also include audio capabilities, or speakers. In an embodiment, the input device 203 may involve a device having velocity detecting abilities.

Figure 10:
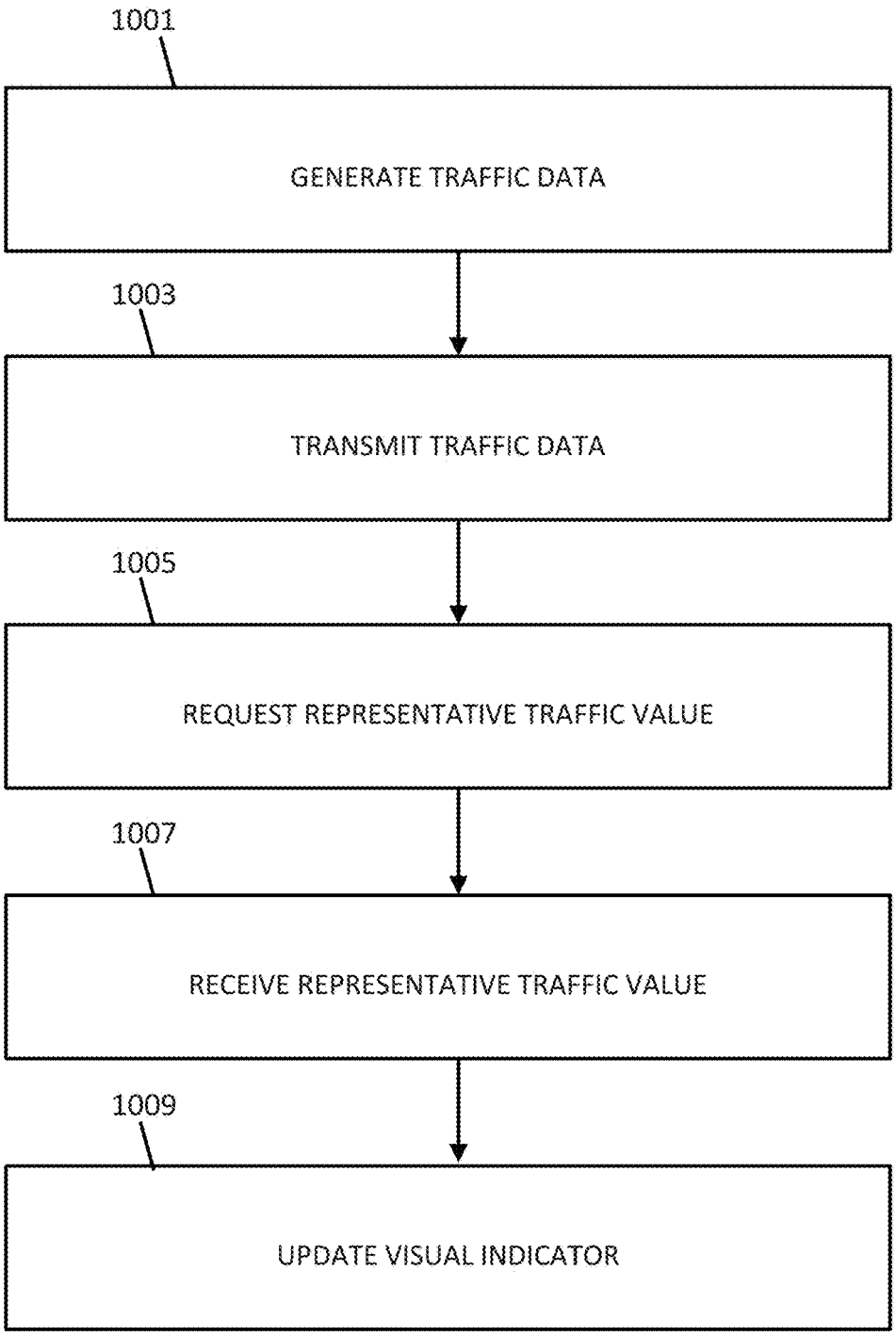
FIG. 10 illustrates an example method for modeling traffic speeds.

FIG. 10 illustrates a flow chart of an example embodiment for modeling traffic speed. As presented in the following sections, the acts may be performed using any combination of the components indicated in FIG. 1, FIG. 8, or FIG. 9. The following acts may be performed by mobile device 122, server 125, or a combination thereof. Additional, different, or fewer acts may be provided. The acts are performed in the order shown or other orders. The acts may also be repeated.

At act 1001, the mobile device 122 generates recent traffic data indicating the speed of a vehicle traveling a road segment. The mobile device 122 may use the positioning circuit 207 or the movement circuit 208 to determine a speed of a vehicle. The mobile device 122 may also be connected to a speedometer in a vehicle or other speed measuring device.

The positioning circuitry 207 may include suitable sensing devices that measure the traveling distance, speed, direction, and so on, of the mobile device 122. The positioning system may also include a receiver and correlation chip to obtain a GPS signal. Alternatively or additionally, the one or more detectors or sensors may include an accelerometer and/or a magnetic sensor built or embedded into or within the interior of the mobile device 122. The accelerometer is operable to detect, recognize, or measure the rate of change of translational and/or rotational movement of the mobile device 122. The magnetic sensor, or a compass, is configured to generate data indicative of a heading of the mobile device 122. Data from the accelerometer and the magnetic sensor may indicate orientation of the mobile device 122. The mobile device 122 receives location data from the positioning system. The location data indicates the location of the mobile device 122.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the mobile device 122. The positioning system may also include a receiver and correlation chip to obtain a GPS signal. The mobile device 122 receives location data from the positioning system. The location data indicates the location of the mobile device 122.

The movement circuitry 208 may include gyroscopes, accelerometers, magnetometers, or any other device for tracking or determining movement of a mobile device. The gyroscope is operable to detect, recognize, or measure the current orientation, or changes in orientation, of a mobile device. Gyroscope orientation change detection may operate as a measure of yaw, pitch, or roll of the mobile device. The movement circuitry 208 may be used alone, or with the positioning circuitry 207 to determine mobile device 122 movement.

At act 1003 the mobile device 122 transmits the recent traffic data to a server 125. The communication interface 205 is configured to send mobile device movement and position data to a server 125. The movement and position data sent to the server 125 may be used to determine traffic flows for a road and segments of the road. The communication interface 205 may also be configured to receive data indicative of an indication of traffic speed for road segments.

The mobile device 122 may send positional data to the server 125. The position circuitry 207 is configured to determine the current location of the mobile device 122. The mobile device 122 may not send traffic speed data with the positional data. The mobile device 122 may receive a potential route though one or more inputs. The mobile device 122 sends the current location and the potential route (one or more road segments) to the server 125.

At act 1005, the mobile device 122 requests a representative traffic data value for one or more road segments. The mobile device 122 may request the traffic for a current road segment, determined by positional data, or a different road segment or a series of road segments that may be part of a planned/potential route.

At act 1007, the mobile device 122 receives the representative traffic data value from the server 125. The representative traffic data value is generated by the server 125. The representative traffic data value is generated by: separating the recent traffic data into one or more zero speed values and non-zero speed values; generating a zero speed data characteristic value from the zero speed values; determining at least one non-zero speed data characteristic value of the non-zero speed data; and generating the representative traffic value for the road segment as a function of the zero speed characteristic value and the non-zero speed characteristic value.

The server 125 may also use historical traffic speed data when generating the representative traffic data value. In an example embodiment, the historical traffic speed data is combined with the recent traffic speed data. This may be necessary if there are few data points for a recent epoch. The representative traffic data may be sent by the server 125 as a single value, a function, a curve, a histogram, and/or a probability function.

At act 1009, the mobile device updates a visual indication of a route or road segment with the representative traffic data value. Different indications of traffic information for various road segments may be used by the mobile device 122. The mobile device 122 may use a visible representation of the traffic levels. Different graphics may be used for different traffic levels. For example, the segments or lengths of road having different traffic levels are presented in different colors, instead of a singular color for the entire length of road. Alternatively, the lengths of road may be displayed in different shapes or widths to convey the traffic levels. In one example, the mobile device 122 generates a message with the traffic level in graphical or alphanumeric values. In one example, the mobile device 122 generates an audible alert.

The communication interface 205 may receive the representative traffic data value from the server 125 through the network 127. The controller may pull the data from the communication interface 205. The controller 200 may be configured to determine a visual indication to a display that represents different traffic speed levels that may be derived from the representative traffic data value. The output interface 211 may be configured to present a visual indication of the traffic speeds to a user of the mobile device 122. The output interface 211 may also be configured to present directions incorporating the traffic speeds for road segments.

The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method comprising:

receiving traffic data generated by positional circuitry in one or more devices configured to record data indicating speeds of vehicles traveling a road segment;

separating, by a processor, the traffic data into zero speed data and non-zero speed data;

determining, by the processor, a zero speed data characteristic value of the zero speed data;

modeling a delta-gamma distribution of traffic flow speeds for the road segment;

determining, by the processor, using the delta-gamma distribution and the non-zero speed data, at least one non-zero speed data characteristic value;

generating, by the processor, a single representative traffic speed value for the road segment as a function of both the zero speed characteristic value and the non-zero speed characteristic value;

selecting, by the processor, using a routing algorithm, the road segment to be used in a route along a road network from an origin location to a destination location as a function of the single representative traffic speed value; and providing, by the processor, the route to a navigation device.

2. The method of claim 1, wherein receiving traffic data comprises:

receiving historical traffic data generated by the one or more devices configured to record data indicating speeds of vehicles traveling a road segment over a first period of time;

receiving recent traffic data generated by the one or more devices configured to record data indicating speeds of vehicles traveling a road segment over a second period of time, wherein the first period of time is longer than the second period of time; and generating the traffic data as a function of the historical traffic data and recent traffic data.

3. The method of claim 1, wherein the one or more devices are one or more roadway sensors configured to record data indicating speeds of vehicles as the vehicles travel near the one or more roadway sensors.

4. The method of claim 1, wherein the one or more devices are one or more probe sensors disposed within a vehicle traveling the road segment.

5. The method of claim 1, wherein determining the zero speed data characteristic value comprises:

determining the zero speed characteristic value as a percentage of a number of zero speed data points to a total number of traffic data points of the traffic data.

6. The method of claim 1, wherein modeling the gamma distribution of traffic flow speeds comprises:

generating one or more gamma distribution parameters as a function of one or more historical gamma distribution parameters.

7. The method of claim 1, wherein the generating the zero speed data characteristic value comprises:

generating one or more delta gamma distribution parameters of the zero speed data as a function of a delta gamma distribution estimation of the zero speed data.

8. The method of claim 1, further comprising:

receiving historical traffic values, wherein the historical traffic values are used by the function to generate the single representative traffic speed value.

9. The method of claim 1, further comprising:

generating, by the processor, a recent traffic speed histogram from the single representative traffic speed value;

receiving, by the processor, a historical traffic speed histogram, generating, by the processor, a final delta histogram by combining the recent traffic speed histogram and the historical traffic speed histogram, and determining, by the processor, a final traffic speed value from the final delta histogram.

10. An apparatus comprising:

at least one processor; and a memory coupled with the processor and including computer program code and operable to store traffic data generated by positional circuitry in devices configured to record traffic data representing speeds of vehicles traveling a road segment; and the at least one memory and the computer program code configured to, with the at least one processor, cause the apparatus at least to:

separate the traffic data into zero speed data and non-zero speed data;

determine a zero speed characteristic value of the zero speed data;

model a non-gaussian distribution of traffic flow speeds for the road segment;

determine, using a non-zero parameter of the non-gaussian distribution model and the non-zero speed data, at least one non-zero speed characteristic value of the non-zero speed data;

generate a single representative traffic speed value for the road segment as a function of both the zero speed characteristic value and the non-zero speed characteristic value;

select the road segment to be used in a route along a road network from an origin location to a destination location as a function of the single representative traffic speed value; and provide the route to a navigation device.

11. The apparatus of claim 10, the memory further operable to:

store historical traffic data generated and store recent traffic data generated by devices configured to record the traffic data representing speeds of vehicles traveling the road segment; and combine the historical traffic data and the recent traffic data to generate the traffic data.

12. The apparatus of claim 10, wherein the one or more devices are one or more roadway sensors configured to record data indicating speeds of vehicles as the vehicles encounter the one or more roadway sensors or the one or more devices are one or more probe sensors disposed within a vehicle traveling the road segment.

13. The apparatus of claim 10, wherein the at least one memory and the computer program code are further configured to, with the at least one processor, cause the apparatus to perform at least the following:

generate at least one parameter of the distribution as a function of one or more historical gamma distribution parameters.

14. The apparatus of claim 10, wherein the at least one memory and the computer program code are further configured to, with the at least one processor, cause the apparatus to perform at least the following:

generate one or more parameters of the distribution of the zero speed data as a function of a delta distribution estimation of the zero speed data and one or more parameters of the distribution of the non-zero speed data as a function of a gamma distribution estimation.

15. A method comprising:

determining, using positional circuitry, a location for a mobile device;

sending a request for traffic speed and the location to a server;

receiving a single representative traffic speed value for the location from the server, wherein the single representative traffic speed value is generated by the server as a function of both at least one zero speed data characteristic value from zero speed values, at least one non-zero speed data characteristic value of non-zero speed data from nonzero speed values, and a delta-gamma distribution of traffic flow speeds for the location; and generating a route from the location to a destination as a function of at least the single representative traffic speed value for the location.

16. The method of claim 15, further comprising:

updating a visual indicator of the single representative traffic speed value; and displaying the visual indicator of the single representative traffic speed value.

17. The method of claim 15, further comprising:

generating recent traffic data indicating a speed of one or more vehicles traveling a road segment; and transmitting the recent traffic data to the server.

18. The method of claim 17, further comprising:

combining the recent traffic data with previously received traffic data for the road segment.

19. The method of claim 15, wherein the route includes one or more maneuvers to be performed automatically by an autonomous vehicle.

20. The method of claim 15, wherein the route includes one or more maneuvers to be performed by a highly automated vehicle.

* * * * *